US011493201B2

(12) United States Patent
Faraldi et al.

(10) Patent No.: US 11,493,201 B2
(45) Date of Patent: Nov. 8, 2022

(54) STEAM GENERATOR AND HOUSEHOLD APPLIANCE

(71) Applicant: Electrolux Appliances Aktiebolag, Stockholm (SE)

(72) Inventors: Paolo Faraldi, Forli (IT); Lorenzo Gattei, Forli (IT); Agostino Rossato, Forli (IT); Nicola Guida, Forli (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 247 days.

(21) Appl. No.: 15/033,394

(22) PCT Filed: Jan. 5, 2015

(86) PCT No.: PCT/EP2015/050035

§ 371 (c)(1),
(2) Date: Apr. 29, 2016

(87) PCT Pub. No.: WO2015/106980

PCT Pub. Date: Jul. 23, 2015

(65) Prior Publication Data

US 2016/0273757 A1 Sep. 22, 2016

(30) Foreign Application Priority Data

Jan. 15, 2014 (EP) ..... 14151215

(51) Int. Cl.
*F22B 1/28* (2006.01)
*F24C 15/00* (2006.01)

(52) U.S. Cl.
CPC ..... *F22B 1/282* (2013.01); *F24C 15/003* (2013.01)

(58) Field of Classification Search
CPC ..... F22B 1/282; F22B 1/02; F24C 15/003; F24C 13/00; A21B 3/04; A21B 1/24;
(Continued)

(56) References Cited

U.S. PATENT DOCUMENTS 1,546,746 A * 7/1925 Orum ..... F22B 27/16 122/451.1
1,946,547 A * 2/1934 Russell ..... F24H 1/142 392/307

(Continued)

FOREIGN PATENT DOCUMENTS

CN 203138106 U * 8/2013 ..... A47J 31/54
DE 20110811 U1 9/2001

(Continued)

OTHER PUBLICATIONS

Random House College Dictionary, 1982, p. 430. Definition of "elute".*

(Continued)

*Primary Examiner* — Phuong T Nguyen
(74) *Attorney, Agent, or Firm* — Pearne & Gordon LLP

(57) ABSTRACT

A cooking appliance includes a cooking cavity adapted to cook food therein; and a steam generator adapted to supply steam for cooking to the cooking cavity. The steam generator includes an L-shaped conduit for steamable fluid having one vertical arm and one horizontal arm, and a heating element located adjacent and external to the L-shaped conduit. The vertical arm is substantially vertical in an operative position of the steam generator.

19 Claims, 4 Drawing Sheets

(58) Field of Classification Search
CPC . F24H 1/38; F23B 13/005; A47J 27/04; A47J 27/06; A47J 27/16; A47J 2027/043
USPC ..... 219/401, 369, 520, 391, 393, 395, 396, 219/397, 398, 399, 402, 405, 407, 408, 219/409, 410; 392/478, 480; 122/367.1, 122/509; 126/348, 5, 20, 78
See application file for complete search history.

(56) References Cited

U.S. PATENT DOCUMENTS 2,706,240 A * 4/1955 Hackman ..... F22B 1/28 392/399
4,660,542 A 4/1987 Scherer
5,058,194 A * 10/1991 Violi ..... F22B 1/284 392/400
5,150,448 A * 9/1992 Salomon ..... A47J 31/542 392/397
5,968,574 A * 10/1999 Sann ..... A23L 5/13 126/20
6,442,341 B1 * 8/2002 Wu ..... A47J 31/542 392/479
2004/0206411 A1 * 10/2004 Connor ..... B29C 63/343 138/98
2005/0131263 A1 * 6/2005 Wolpert ..... C10G 9/20 585/652
2008/0142510 A1 * 6/2008 Clark ..... H05B 6/34 219/643
2008/0223352 A1 * 9/2008 Ando ..... F24C 15/327 126/20
2009/0007798 A1 1/2009 Yamaguchi et al.
2013/0202279 A1 * 8/2013 Reichl ..... F24H 1/142 392/480
2013/0344214 A1 * 12/2013 Tong ..... A21B 3/04 426/511

FOREIGN PATENT DOCUMENTS

| | | | |
|---|---|---|---|
| DE | 20120611 | U1 | 2/2003 |
| DE | 102007048567 | | 4/2009 |
| EP | 0432460 | | 6/1991 |
| EP | 2650615 | | 10/2013 |
| FR | 2678359 | | 12/1992 |
| FR | 2895066 | A1 | 6/2007 |
| FR | 2958727 | A1 | 10/2011 |
| GB | 0744547 | A | 2/1956 |
| JP | H065122 | A | 1/1994 |
| JP | 2004245467 | A | 9/2004 |

OTHER PUBLICATIONS

International Search Report issued in PCT/EP2015/050035 dated Mar. 13, 2015, 3 pages.
Examination Report issued in corresponding Australian Patent Application No. 2015206110 dated Dec. 6, 2018, 9 pages.
Response to Office action dated Oct. 4, 2018 for co-pending U.S. Appl. No. 14/417,675 listing the current claims therein, owned by Electrolux Home Products Corporation N.V.
European Communication for application No. 14151215.2, dated Nov. 18, 2020, 17 pages.

* cited by examiner

STEAM GENERATOR AND HOUSEHOLD APPLIANCE

In modern household environments, space and energy consumption become more and more important. Consumers want to use small devices that have full functionality without sacrificing space of their living environment. Energy consumption of household appliances and energy density as a prerequisite to build compact devices contribute to technical advantages over the competition. In the area of food preparation, recently steam ovens have taken inroads into modern kitchens. They allow the tasty preparation of food dishes, by at the same time as much as possible protecting vital ingredients such as vitamins and flavors.

By introducing water or steam into the cooking cavity of a steam oven in order to create special food cooking conditions, food can be prepared while at the same time burning of food in the oven is prevented. Related processes can be carried out according to different methods and under widely differing conditions. The so-called steaming process letting water or steam into the cooking cavity is widely known and based on a generation of steam, either on a boiler arrangement located outside the cooking cavity or on a heated pan filled with water inside the cavity. Regarding performance and effective system integration, the steam generator type and its build is a key factor to implement a fully functional device that leads to satisfying cooking results. One type of such a generator is a flow-type generator. Flow-type devices are also known from electrical heating for shower applications in bathrooms. In a steam generator environment, water enters on one side and steam exits on the other side of the generator.

The German patent application publication DE 10 2009 055148 A1 related to a steam generating system and a household appliance as well as a method for mounting such a steam generating system discloses a V- to U-shaped flow-type generator as a steam generator of a household appliance. In the drawings it is shown that the V- and the U-shape of the generator is realized by the additional tubing of the household appliance. The heated flow-type steam generator of the device itself, the flow-type heater (3) in FIG. 2 with entry (ID) and exit (AD) is of the linear type and mounted at an angle of 60° to 70° (FIG. 2).

No other related prior art is known.

The invention is based on the problem to provide a more efficient and robust steam generator and a household appliance comprising such a steam generator.

This problem is solved according to the invention by a steam generator according to claim 1 and a household appliance according to claim 14.

Advantageous further developments of the invention are given in the dependent claims.

Advantageously, a steam generator according to the present invention heats the fluid to be steamed over a longer distance, while at the same time it allows limestone to be scaled off and fall down, thus further increasing the heat exchange efficiency.

Beneficially, according to a further development of a steam generator according to an embodiment of the present invention, two bent arms of conduits have a different length. This beneficially allows it to make one of the arms of the conduit longer which is heated and completely filled with the fluid to be steamed. This allows increasing the amount of energy that is transmitted into the fluid by the steam generator. Further, different dimensions of the two arms of the conduit beneficially take care of the fact that kitchen appliances are usually not of a square cross-section, but rather of a rectangular cross-section and thus allow to fully exploit the form factor of household appliances that are commonly used. Consequently a steam generator according to such an implementation can be better adapted to the shape of the household appliance.

Beneficially, according to a further development of an embodiment of a steam generator according to the present invention, one of the arms is completely filled with a steamable fluid whereas the other one is at least partially filled with steamable fluid, which further increases the amount of energy that can be transmitted into the fluid, while at the same time allowing limestone that is generated, e.g. when water is steamed, to fall into a fluid reservoir and be removed by fluid motion or gravity.

Favorably, the angle that is formed between the two arms of a steam generator of the present invention conforms to certain discrete values, which in practice have shown to be efficient as well as achieving a good heat transfer rate and steam generation.

Further advantageously, according to a further development of an embodiment of the steam generator of the present invention, heating elements or the heating element cover as much as possible of the length of both arms of the steam generator according to the present invention in order to maximize the heat transfer into the fluid to be steamed.

Favorably, one arm of the steam generator according to a further development of an embodiment of the present invention is mounted substantially vertical in an operative state of the steam generator in order to achieve optimum steam generating conditions as well as heat transfer, while at the same time providing for good limestone removal in case that water is steamed.

Advantageously, according to a further development of an embodiment of the steam generator according to the present invention, the conduit is made from extruded material. In particular aluminum maybe used, which allows it to produce profiles with a longitudinal extension in an efficient manner. At the same time aluminum and limestone have a different heat extension coefficient which leads to a chipping-off of the limestone during heating and cooling of the steam generator.

Favorably, according to a further development of an embodiment of the steam generator of the present invention, the conduit is symmetrical because symmetrical conduits are easy to be manufactured and can be efficiently produced.

Advantageously, according to a further development of an embodiment of the steam generator according to the present invention, the conduit conforms to certain dimensions of an inner diameter which has proven to be an optimum for solutions in practical steam ovens.

Further advantageously, a further development of a steam generator according to an embodiment of the present invention has a conduit with an inner profile. Such an inner profile provides for a greater surface for heat transfer and thus further increases the heat exchange rate in the steam generator. Further, such a profile can be optimized to optimally chip off limestone during heating and cooling of a steam generator due to the different thermal expansion rates of the different materials.

Further advantageously, according to a further development of an embodiment of the steam generator according to the present invention, the surface area provided by an inner profile and the surface area conforming to a flat inner surface of the conduit stand in a particular relation for optimum heat transfer which conforms to particular value ranges that have proven beneficial in practical applications.

Further advantageously, according to a further development of an embodiment of the steam generator according to the present invention, it comprises a support structure which allows it to be fixed inside of a household appliance. In this manner, beneficially, the positioning and fixing inside of a household appliance of a steam generator according to the present invention can be facilitated, while at the same time securing a defined angular position in an operative state of the steam generator.

Advantageously, a household appliance according to the present invention comprises a steam generator according to embodiments of the present invention. Such a household appliance is compact, energy-efficient and very robust in terms of service and maintenance, as due to the limestone removal capabilities of the steam generator it is more energy-efficient and does not need any short regular service intervals to remove limestone.

Further beneficially, according to a further development of the household appliance according to an embodiment of the present invention, the support structure in the operative position in the household appliance maintains one arm of the steam generator in a horizontal position. This provides for an optimum heat transfer into the fluid to be steamed while at the same time providing for maximum geometrical exploitation of the space available in a household appliance.

Subsequently, embodiments of the invention will further be explained on the basis of examples given in the drawings wherein.

Figure 4:
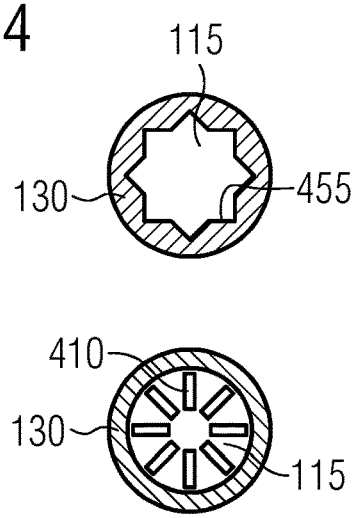
Figure 5:
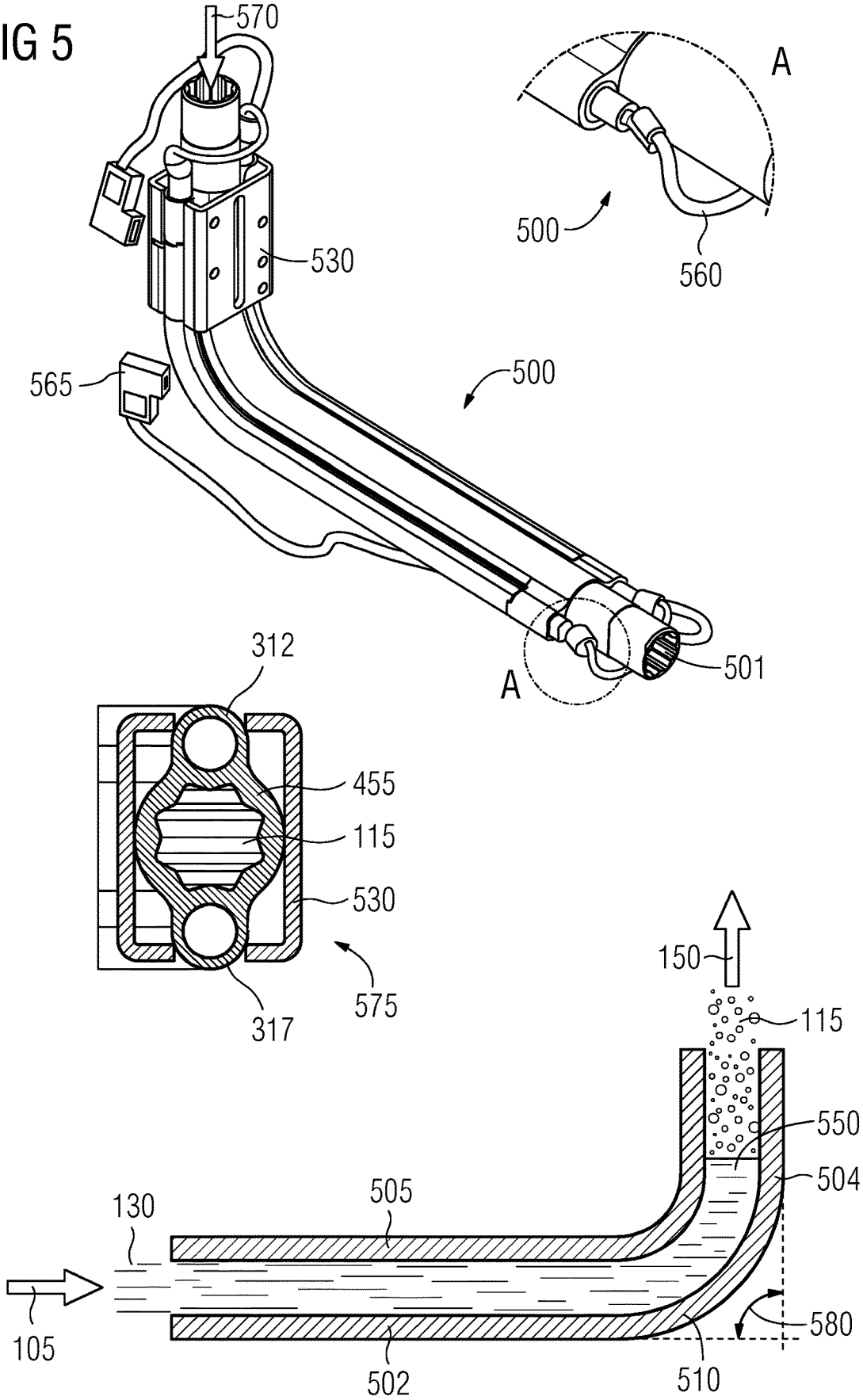
Figure 6:
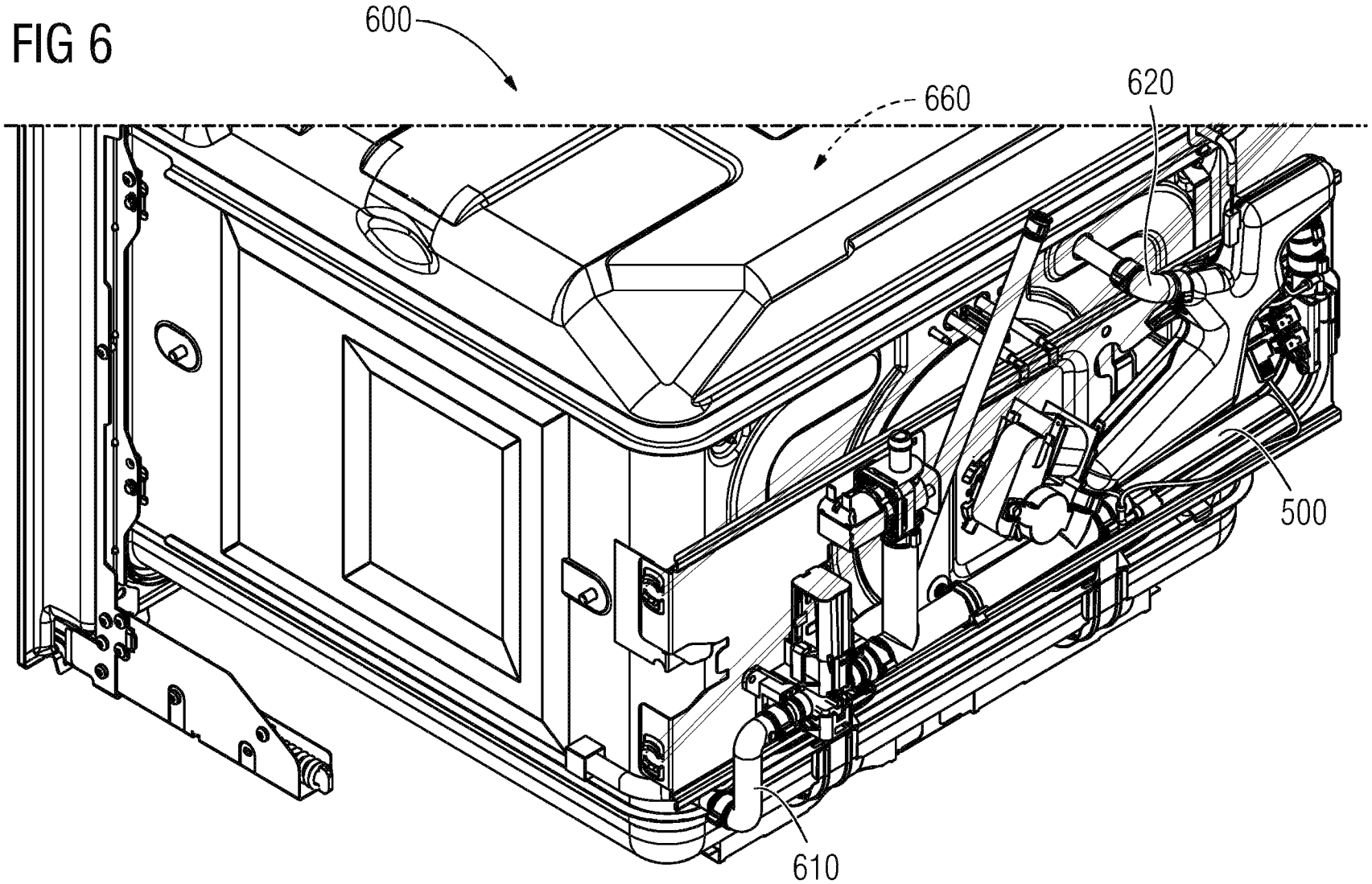

FIG. 4 gives examples for inner profiles of flow-type generators;

FIG. 5 gives an example of a flow-type steam generator according to an embodiment of the present invention; and FIG. 6 gives an example of a household appliance and a steam generator built into it in an operative position.

Figure 1:
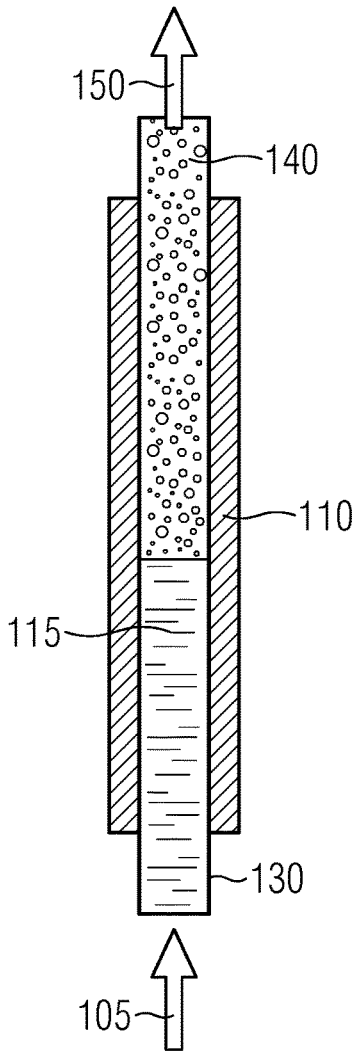
FIG. 1 and FIG. 2 show flow-type steam generators according to the prior art.

As FIG. 1 shows, a linear flow-type steam generator is most commonly mounted in a vertical position. As a fluid to be steamed generally water is used, but flow-type generators also work for other fluids such as alcohol. There is a fluid entry 105 and a steam exit 150. FIG. 1 also shows the fluid 130 and the steam 140. Also, a conduit 115 is identified which is covered by a heating element 110. The fact that only one heating element is shown here serves only illustrative purposes. There can be plural heating elements, and they can be separated by gaps in order to optimize the heat transfer into the fluid 130. Generally, a conduit receives water and is beneficially being produced from an extruded aluminum profile. A heating element 110 is preferably made of nickel alloy wires that are insulated e.g. by magnesium oxide powder. Generally, power ranges of common devices range e.g. between 500 Watt to 1500 Watt.

Flow-type heating elements are usually mounted in a horizontal or slightly tilted position.

Figure 2:
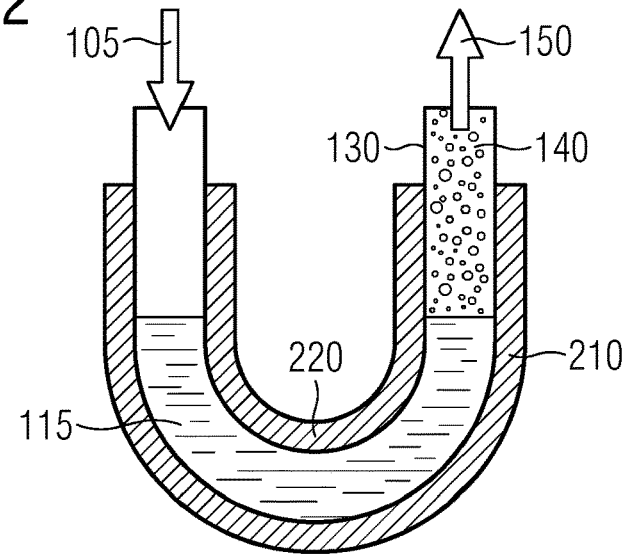

FIG. 2 shows another shape of a flow-type steam generator in a bent manner as already described in the prior art. Here, a U-shaped heat generator is shown. With such a profile, as can be seen from the drawing, it can only partially be filled with fluid 115 in order to be able to generate steam. The heating elements cover almost the entire steam generator with an outer heating element 210 and an inner heating element 220.

Figure 3:
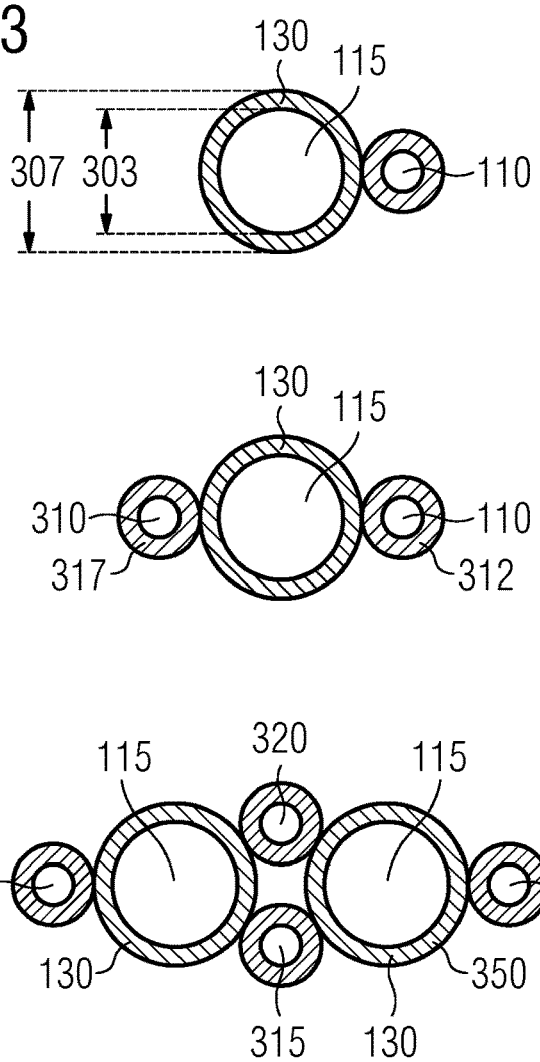
FIG. 3 shows examples of configurations for flow-type generators.

FIG. 3 shows various profiles, which can be manufactured by extrusion to manufacture steam generators according to embodiments of the present invention. A conduit filled with fluid 115 on top of the drawing has an inner diameter 303 and an outer diameter 307 and is shown to be accompanied on the side by one heating element 110. In the middle of the drawing, a central conduit is accompanied by two heating elements 110 and 310 which are integrated into tubes 312 and 317, respectively. The heat transfer into the fluid 115 and the amount of steam to be generated can be further increased by using two conduits 115 and four heating elements 110, 320, 310 and 315 as shown in the lower part of the drawing.

The depicted configurations ensure a maximum of heat exchange between the heating elements 110, 310, 315, 320 and the fluid 115 as well as the conduits enclosing the fluid. The heat transfer can be further increased by providing the conduit with an inner profile as shown in FIG. 4.

FIG. 4 shows examples for two inner profiles. One is sort of star-shaped giving a greater inner surface area 455 for heat transfer from the conduit 130 to the fluid 115. The other has ribs 410 inside, which also increases the heat transfer into the fluid 115. The star-shaped conduit surface design 455 form of the cross-section is in particular advantageous for limestone removal, as the sharp edges, along with thermal expansion differences between aluminum and limestone, crack the limestone layer and scale it out from the surface.

Advantageously, to further maximize the effectiveness of limestone removal, a low adhesion surface treatment can be provided such as PTFE coating of the internal surface of the fluid or water conduit.

FIG. 5 shows an example of an embodiment, which can be considered as a preferred embodiment of the invention. It shows a flow-type steam generator 500. Such a device is e.g. typically manufactured from aluminum by extrusion. In this case, the preferably extruded element 500 is bent to be substantially L-shaped as shown in FIG. 5. The angle 580 between the horizontal arm 502 and the vertical arm 504 is preferably 90° or in excess of 90°, beneficially in a range of 90° to 110° or preferably from 91 to 94°. This allows limestone debris in the case that water is evaporated remaining in the vertical conduit 504 to flow downwards out of the steam generator 500 leading to an efficient natural drain of such debris and enhancing cleansing during de-scaling operations. Inlet of Water 105 takes place at the opening of the horizontal arm 502 of the generator pipe, while steam and/or hot water outlet occurs at the opening of the end of the vertical segment 504 where the steam exits 150.

The mounting position is typically critical for the actual component efficiency as it drives the actual heat exchange by the free fluid surface inside and by the actual surface in contact with the fluid, such as defining the fluid transfer surface inside of the steam generator.

The shape of this embodiment unites both, the advantages of a linear flow-type generator mounted horizontally, which fully exploits the heat exchange surface of the horizontal arm 502, and of vertically positioned arms or generators which provide easy evacuation of generated steam, and adaptation to a relatively wide water level range.

Furthermore, heating linear power density can be calibrated over the length of the steam generator, providing higher heat flow at the intake area, where the water inlet 105 is and water presence 130 can always be ensured.

Characteristic preferred values to define a steam generator are:

- linear power density in terms of Watt/cm,
- heat exchange rate between heating elements and water duct,
- heat exchange rate between water duct walls and water to be evaporated.

Further beneficially, a support structure such as a flange 530 can be provided to the steam generator and fixed to it by welding, brazing or any known mechanical fixing method. The support structure 530 may allow the fixture of the steam generator 500 to an appliance directly or by other intermediate supporting elements and also allows the fixture of accessories as safety thermostats or temperature sensors.

A cross-section of the steam generator 500 in the area of the support structure 530 is shown and indicated by 575. It shows the view from a direction 570. Also shown is an enlarged view A of a cable of the heating element 560 and an associated connector 565. Also indicated are conduits for heaters 312 and 317.

FIG. 6 shows an example of a household appliance 600, in particular a steam oven, that has a steam generator 500 built into it and associated tubing 610 and 620 to connect it to a cooking cavity 660 of the steam oven. As can be seen, the steam generator is built into the household appliance 600 wherein the longer arm of the L-shaped steam generator lies horizontal and the shorter arm lies vertical as also shown in the schematic representation in FIG. 5.

Beneficially, the linear power density of such a steam generator varies from 15 to 60 Watt/cm, preferably from 35 to 45 Watt/cm.

Further beneficially, the ratio between the longer and the shorter arm of the steam generator 502 and 504 is between 1.1 to 1.5, preferably between 1.3 to 1.4.

Further beneficially, the angle between the two arms 502 and 504 is beneficially between 90° and 110°, preferably from 91° to 94°.

Advantageously, the internal profile of a conduit maximizing the surface for heat exchange has a ratio between actual section parameter and nominal average diameter in the range of 1.1 to 5, preferably 1.15 to 1.25. Beneficially, the internal average diameter of the water conduit favorably is in the range of 8 to 16 mm, preferably between 11 and 13 mm.

Preferable, the support structure 530 is fixed to the shorter arm 504.

LIST OF REFERENCE NUMERALS

105 fluid entry
150 fluid exit
110 heating element
130 fluid conduit
115 fluid
150 steam
220 inner heating element
210 outer heating element
303 inner diameter
307 outer diameter
312, 317 conduits for heating elements
310, 315, 320 heating elements
455 star-shaped profile of water conduit
410 rib-shaped profile of water conduit
500 embodiment of steam generator
502 first arm
504 second arm
550 fluid level
505 inner heating element
510 outer heating element
530 support structure
575 top view
570 view direction
565 connector
501 conduit
A enlarged view
580 angle between arm 502 and arm 504
600 household appliance
610 tubing
620 tubing

The invention claimed is:

1. A steam generator comprising:
an L-shaped conduit for steamable fluid comprising one vertical arm and one horizontal arm; and
a heating element located adjacent and external to said L-shaped conduit, said vertical arm being substantially vertical in an operative position of the steam generator,
wherein the L-shaped conduit has an inner surface that comprises a series of protuberances distributed about the inner surface, and
wherein the steam generator is operable to receive the steamable fluid within the L-shaped conduit and heat the steamable fluid to produce steam.

2. The steam generator according to claim 1, wherein the protuberances form ribs.

3. The steam generator according to claim 1, wherein a flow path of the L-shaped conduit through the vertical arm and the horizontal arm thereof has a constant cross-sectional area.

4. The steam generator according to claim 1, wherein the L-shaped conduit is symmetrical about an imaginary vertical plane that passes through a center line of the L-shaped conduit.

5. The steam generator according to claim 1, said vertical arm and said horizontal arm forming an angle with one another, said heating element covering at least partially the vertical arm and the horizontal arm of the conduit.

6. The steam generator according to claim 5, wherein the heating element is continuous between a first portion thereof that covers the vertical arm and a second portion thereof that covers the horizontal arm.

7. The steam generator according to claim 1, further comprising:
first and second heater conduits running parallel and adjacent to the L-shaped conduit on opposite sides thereof, said heating element being disposed within said first heater conduit, and
a further heating element being disposed within said second heater conduit.

8. The steam generator according to claim 1, wherein an angle between said vertical and horizontal arms is from 90° to 110°.

9. The steam generator according to claim 8, said angle being 91° to 94°.

10. The steam generator according to claim 1, wherein the L-shaped conduit has an inner diameter between 8 and 16 mm.

11. The steam generator according to claim 1, wherein the L-shaped conduit has an inner diameter between 11 and 13 mm.

12. The steam generator according to claim 1, having a support structure to fix said steam generator in said operative position.

13. The steam generator according to claim 1, wherein the L-shaped conduit is made of at least one of extruded material and aluminum.

14. The steam generator according to claim 1, wherein the vertical arm and the horizontal arm have different lengths, wherein at least one of the vertical arm and the horizontal arm is substantially full of steamable fluid in said operative position of the steam generator.

15. The steam generator according to claim 14, wherein the longer arm of said vertical arm and said horizontal arm is the one substantially full of the steamable fluid in said operative position.

16. The steam generator according to claim 14, wherein the shorter arm of said vertical arm and said horizontal arm is at least partially filled with steamable fluid in said operative position.

17. The steam generator according to claim 1, wherein the L-shaped conduit is at least partially filled with water.

18. A cooking appliance comprising:

a cooking cavity adapted to cook food therein; and the steam generator according to claim 1, wherein the steam generator is adapted to supply steam for cooking to the cooking cavity.

19. The cooking appliance according to claim 18, wherein the steam generator is connected to the cooking cavity such that water enters the L-shaped conduit and steam exits the L-shaped conduit and is delivered to the cooking cavity.

* * * * *